US005522457A

United States Patent [19]

Lenz

[11] Patent Number: 5,522,457

[45] Date of Patent: Jun. 4, 1996

[54] HEAT EXCHANGER, PARTICULARLY RADIATOR FOR INTERNAL COMBUSTION ENGINES OF COMMERCIAL VEHICLES

[75] Inventor: Werner Lenz, Mühlacker, Germany

[73] Assignee: Behr GmbH & Co., Stuttgart, Germany

[21] Appl. No.: 458,649

[22] Filed: Jun. 2, 1995

[30] Foreign Application Priority Data

Jun. 22, 1994 [DE] Germany ..... 44 21 835.4

[51] Int. Cl.[6] ..... F01P 11/10

[52] U.S. Cl. ..... 165/121; 123/41.49; 180/68.1

[58] Field of Search ..... 123/41.49; 165/51, 165/121, 122; 180/68.1

[56] References Cited

U.S. PATENT DOCUMENTS

| | | | |
|---|---|---|---|
| 3,795,274 | 3/1974 | Fieni | 165/122 |
| 4,185,688 | 1/1980 | Wiater et al. | 165/122 |
| 4,210,833 | 7/1980 | Neveux | 310/58 |
| 4,622,822 | 5/1987 | Foeldesi et al. | 415/213.1 |
| 4,685,513 | 8/1987 | Longhouse et al. | 165/121 |
| 4,955,434 | 9/1990 | Price | 165/122 |
| 5,327,956 | 7/1994 | Bolton et al. | 165/121 |
| 5,341,871 | 8/1994 | Stelzer | 165/121 |

FOREIGN PATENT DOCUMENTS

| | | | |
|---|---|---|---|
| 3918176A1 | 12/1980 | Germany . | |
| 3536457A1 | 6/1987 | Germany . | |
| 3744644A1 | 7/1989 | Germany . | |
| 3907926A1 | 9/1990 | Germany . | |
| 9319025 U | 3/1994 | Germany . | |
| 4244037A1 | 6/1994 | Germany . | |
| 2130304 | 5/1984 | United Kingdom | 123/41.49 |

OTHER PUBLICATIONS

German Srch. Rep. Feb. 3, 1995.

*Primary Examiner*—Allen J. Flanigan

*Attorney, Agent, or Firm*—Evenson McKeown Edwards & Lenahan

[57] ABSTRACT

The fastening of a fan shroud on water boxes of a heat exchanger is byway of a swivel pin/hinge connection and by way of at least one plug-type bracket which engages in a receiving pocket in the case of a swivel operation. Only a swivel operation will then be required for the mounting which can be carried out in an easy manner.

19 Claims, 3 Drawing Sheets

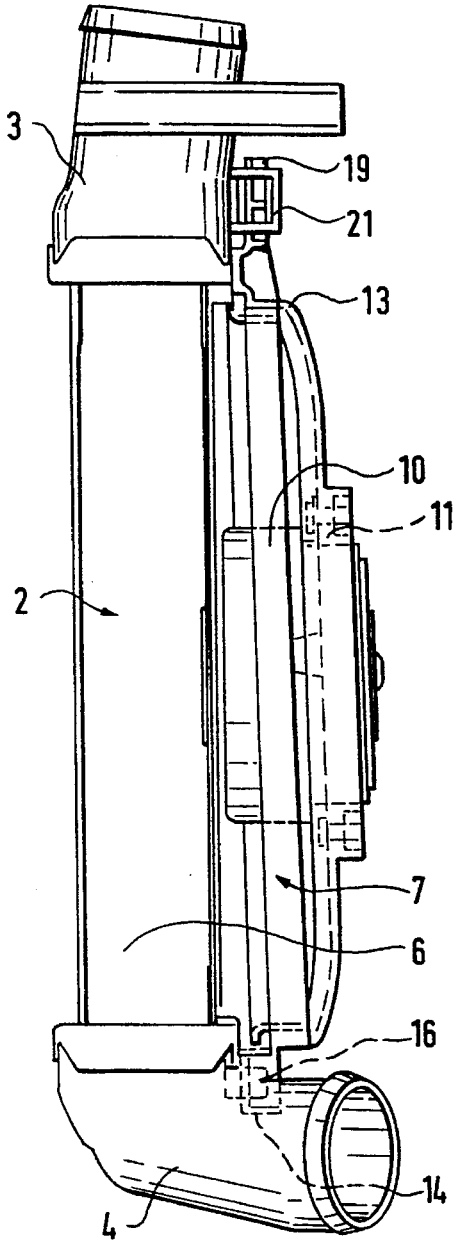
FIG.3
FIG.4
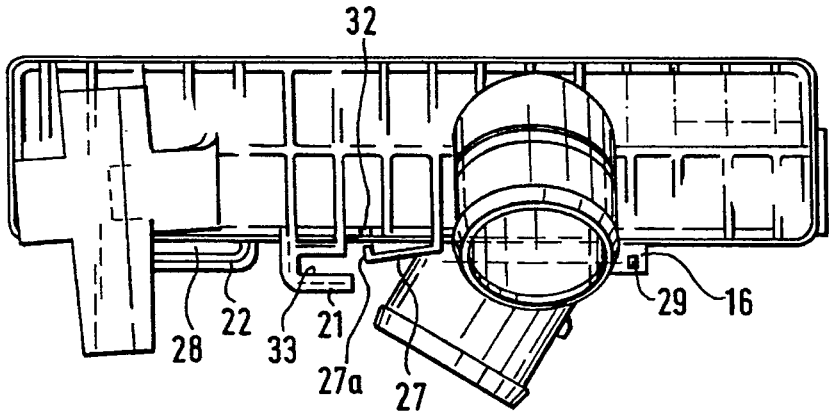

HEAT EXCHANGER, PARTICULARLY RADIATOR FOR INTERNAL COMBUSTION ENGINES OF COMMERCIAL VEHICLES

BACKGROUND AND SUMMARY OF THE INVENTION

This invention relates to a heat exchanger, particularly a radiator for internal-combustion engines of commercial vehicles, comprising a fan shroud which is arranged in front of a ribbed tube block and which is held on the collecting tanks of the ribbed tube block by being placed on it perpendicularly to the front side and then by a relative movement in parallel to the front side by means of a form closure of mutually engaging plug-type brackets with detent devices.

A heat exchanger of this type is known from German Patent Document DE 39 07 926 A1 in the case of which the installation of the fan shroud and the collecting tanks constructed as water boxes is effected by sliding brackets which engage in one another in a locking manner when the fan shroud, first being vertically aligned, is placed by means of corresponding stop guides on the water boxes and is then laterally shifted by a certain extent until the sliding brackets lock in their guides. For the mounting of the fan shroud on the radiator, heat exchangers of this type require only a parallel shifting to the front side but no other fastening devices. Nevertheless, because of the required vertical alignment, the mounting operation is not always easy, particularly when the assembly or a later demounting on the vehicle is to be carried out and the space conditions in the engine compartment are narrow.

It is also known (German Patent Document DE-OS 35 36 457) to carry out the fastening of a fan shroud on collecting tanks by means of elastic shackles with detent hooks, which shackles project from the plane of the edge of the fan shroud into the interior to the ribbed tube block and which detent hooks reach behind corresponding edges of webs on the collecting tank. In this case, stop surfaces on the edge of the fan shroud which are used for securing the position are assigned to the spring shackles. Although this type of fastening ensures a relatively simple mounting, since the form closure is essentially achieved only by means of detent hooks, these constructions, when the heat exchanger is used in the commercial vehicle field, may result in a release of the form closure because of the then occurring severe stresses.

It is an object of the invention to further develop a heat exchanger of the initially mentioned type in such a manner that the mounting between the fan shroud and the heat exchanger assembly is facilitated. For achieving this object, at least one swivel pin/hinge connection is provided between the fan shroud and the collecting tanks and plug-type brackets and detent devices are arranged such that the form closure can take place by a swivelling of the fan shroud about the swivel pin.

This development has the important advantage that only the swivel pin/hinge connection between the fan shroud and the collecting tanks must be established which, however, because only one pin must be introduced into a corresponding opening, requires no difficult aligning operations. Subsequently, a swivelling of the fan shroud about the swivel pin can take place in a simple manner, while the mounting operation no longer requires any significant attention. After the swivel operation, the fan shroud will be locked on the collecting tanks in a form-closing manner.

In a further development of the invention, the swivel pin may be provided on the lower collecting tank and at least one plug-type bracket may be provided on the upper collecting tank so that a good fastening can be achieved. However, it is advantageous for the plug-type pin to be arranged in the area of a lateral part on the lower collecting tank, for a plug-type bracket to be assigned approximately to the center of the upper collecting tank, and for another plug-type bracket to be arranged on the side of the lower collecting tank facing away from the swivel pin. As a result of these measures, a type of three-point fastening is obtained which ensures a secure contact arrangement.

In a further development of the invention, the plug-type bracket may be constructed on the upper collecting tank as a U-shaped receiving pocket into which a bracket engages in a fitting manner which is connected with the fan shroud. In this case, an elastic detent hook, which is mounted on the collecting tank, may secure this bracket in the end position. The lower plug-type bracket, which is arranged on the lower collecting tank, may be constructed as a plug-type slot into which a bracket projecting from the fan shroud can be inserted in a fitting manner. In this case, this bracket can be arranged on the fan shroud in such a manner that its longitudinal axis extends approximately tangentially with respect to a circular are whose center is the swivel pin, In this manner, the bracket can be introduced particularly easily by means of the swivel movement into the slot assigned to it. Finally, it is advantageous for a contact web to be assigned to the bracket arranged on the fan shroud and engaging in the upper collecting tank, which contact web is pressed against a contact surface of the collecting tank in the end position of the fan shroud.

Other objects, advantages and novel features of the present invention will become apparent from the following detailed description of the invention when considered in conjunction with the accompanying drawings.

BRIEF DESCRIPTION OF THE DRAWINGS

FIG. 3 is a lateral view of the heat exchanger of FIG. 2 viewed in the direction of the arrow III; and FIG. 4 is a top view of the heat exchanger of FIG. 2 in the direction of the arrow IV, but without the mounted fan shroud.

DETAILED DESCRIPTION OF THE DRAWINGS

Figure 1:
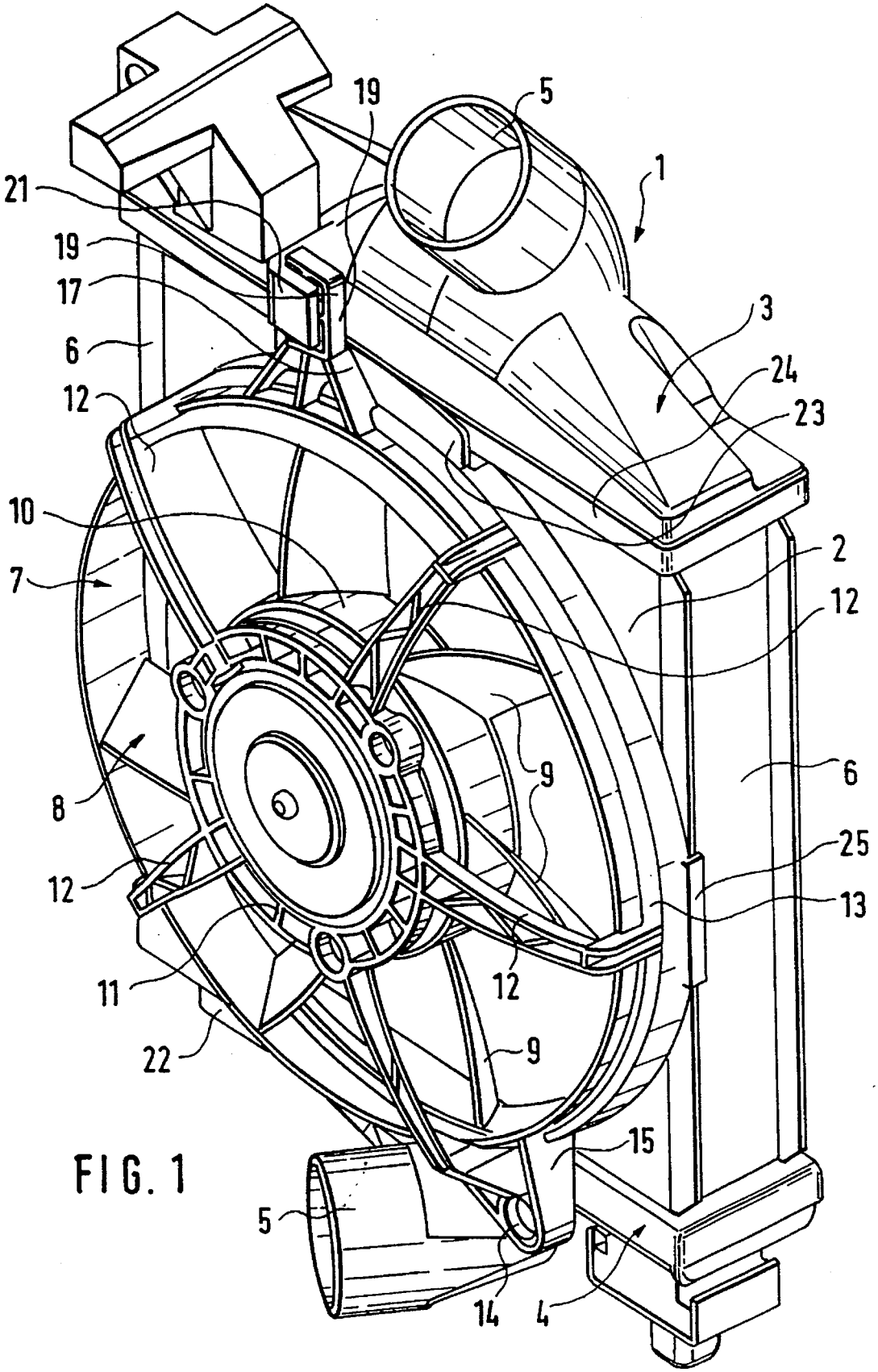
FIG. 1 is a schematic perspective representation of a heat exchanger comprising a fan shroud fastened on a ribbed tube block constructed according to a preferred embodiment of the invention.

FIG. 1 illustrates a heat exchanger which, as a whole, has the reference number 1 and which, in a known manner, comprises a ribbed tube block 2 with an upper collecting tank 3 constructed as a water box and with a lower collecting tank 4 also constructed as a water box, which are each provided with inlet and outlet connection pieces 5 for the heat exchange medium. The ribbed tube block 2 is bordered by lateral parts 6 which are connected with the upper and the lower collecting tank 3, 4.

Figure 2:
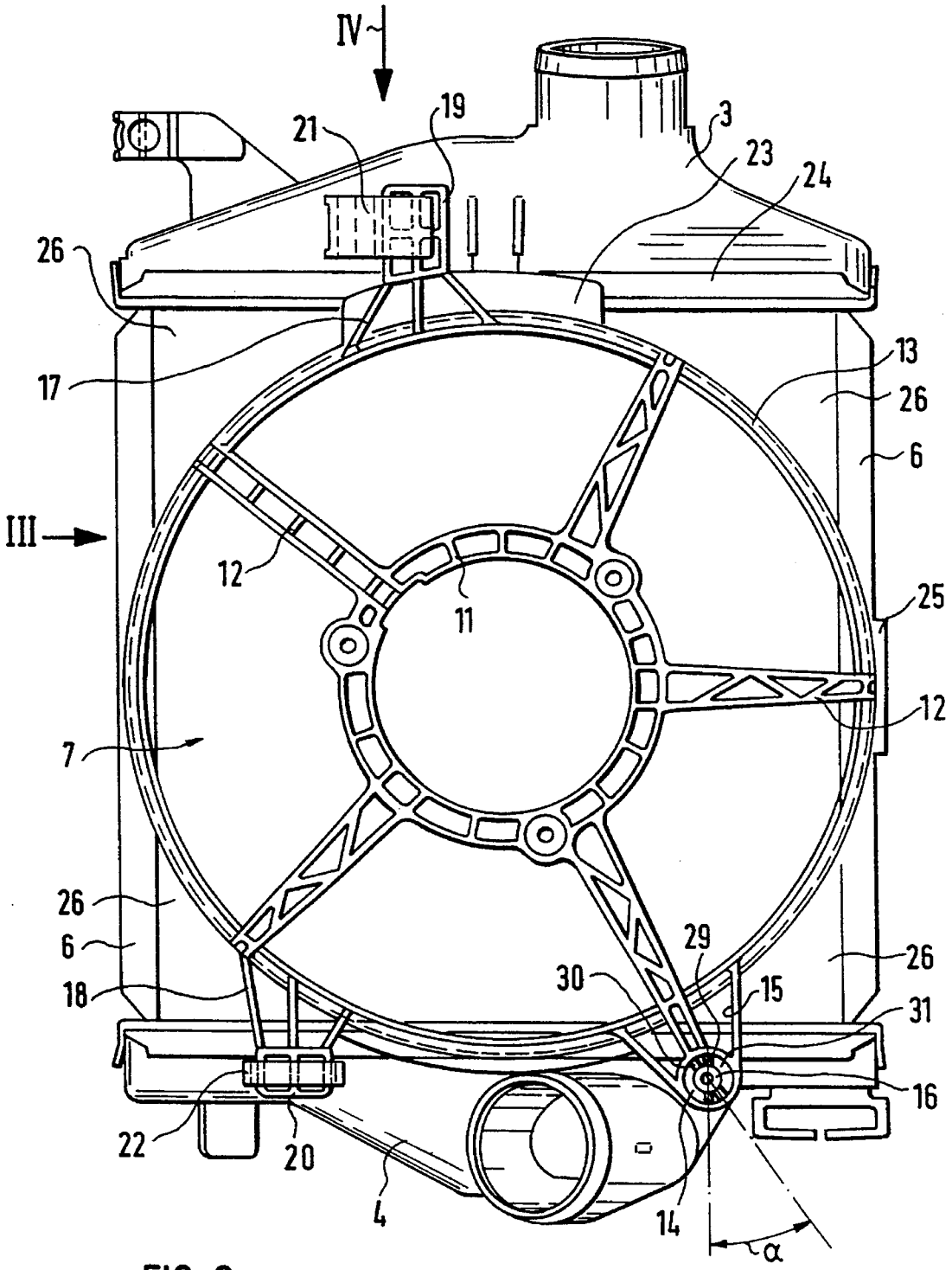
FIG. 2 is a schematic representation of a frontal view of the heat exchanger of FIG. 1 with the fan shroud in the mounted condition.

A fan shroud 7 is fitted onto the front side of the heat exchanger facing the viewer. Fan shroud 7 is used for holding a fan 8 whose blades 9 are mounted in a known manner on a root 10 which is provided with an electric motor. The motor is in turn disposed in a fastening ring 11 of the fan shroud 7, which fastening ring 11, in turn, is connected by way of radially extending fastening webs 12 with a fastening ring 13 of the fan shroud 7. The whole fan shroud 7 is held by means of its fastening ring 7 on the front side of the heat exchanger 1 by way of a sleeve 14 which acts as a hinge and which is mounted on a web 15 projecting diagonally downward from the fastening ring 13. The sleeve 14 is held by way of a swivel pin 16, which is illustrated in FIGS. 2 to 4, in a manner which will be explained in detail, against the front side, and this fastening position is secured in the mounting position by means of two brackets 19, 20 which also project by way of webs 17, 18 from the fastening ring 13 and which are introduced into corresponding receiving devices 21, 22 which project from the upper collecting tank 4 and the lower collecting tank 4 beyond the front side.

A stop web 23 which, in the shown mounting position, is firmly pressed against a corresponding stop edge 24 of the upper collecting tank 3, is assigned to the upper bracket 19. In addition, the fastening ring 13 is provided with a stop piece 25 by means of which it is placed from the outside against a lateral part 6.

The receiving part which is assigned to the upper bracket 19 is constructed as a U-shaped receiving pocket 21 which is constructed in such a manner that the bracket 19 is firmly placed against the interior side of the outer bow part and thus permits a pressing of the fastening ring 13 and of the contact web 23 against the assigned collecting tank. In the case of the embodiment shown, the areas between the collecting tanks and the lateral parts, on the one hand, and the fastening ring 13, on the other hand, are with corresponding corner coverings so that the air delivered by the fan 8 can flow through the ribbed tube block in an intensive manner.

An elastic detent hook 27 is connected in front of the receiving pocket 21, which detent hook 27 is pressed to the side by the bracket 19 during the mounting operation, as will be explained in the following, but which, when the bracket 19 has reached its end position, is placed by means of its forward end 27*a* against the bracket 19 and prevents an unintentional release of the bracket from the receiving pocket 21.

FIG. 4 also illustrates clearly that the receiving device 22 assigned to the lower bracket 20 is a bow projecting from the front side of the lower collecting tank 4 which forms a slot 28 for introducing the bracket 20.

Finally, the swivel pin 16, which is fastened on the lower collecting tank 4 and also projects to the front side, at a defined distance from its base, has two diametrically opposite pins 29 whose significance will be explained in the description of the mounting operation. The sleeve 14 to be pushed onto the swivel pin 16 is finally provided with two slots which start from its inside diameter, are also situated in a diametrically opposite manner and in their dimensions are adapted to those of the pins 29 and which, as will be explained in the following, can be pushed over the pins 29.

In the fastening condition illustrated in FIGS. 1 to 3 of the fan shroud 7 on the ribbed tube block 2 and on the collecting tanks 3, 4, a three-point fastening exists in each case in the area of the sleeve 16, of the bracket 19 and of the bracket 20. The brackets 19, 20 engage in their receiving devices 21, 22. By means of the pin 29 of the swivel pin 16, the sleeve 14 is held in the position illustrated in FIGS. 1 to 3 and is also firmly pressed against the front side of the heat exchanger.

The mounting operation takes place as follows:

The fan shroud 7 is first swivelled clockwise by an angle ($\alpha$) of approximately 45° in a position opposite the position illustrated in FIGS. 1 and 2, is fitted onto the swivel pin 16 of the lower collecting tank 4, specifically until the fastening ring 13 and the contact web 23 come in contact with the front side of the collecting tanks 3, 4. In this position, the slots 30 can therefore be pushed over the pins 29 of the swivel pin 16 so that these pins 29 are situated in front of an edge 31 in the sleeve 14. In this position, in which therefore the contact web 23 rests against the contact surface 24, the fastening operation can now be initiated in that the fan shroud 7 is swivelled counterclockwise about the angle ($\alpha$). In this case, on the one hand, the pins 29 of the swivel pin 16 reach over the surface 31 in the hinge sleeve 14; on the other hand, the bracket 19 arrives in the area of its U-shaped receiving pocket 21 and, in the process, presses the detent hook 27 situated in front of the open end of the receiving pocket 21 clockwise toward the inside where its end can be received, for example, in a recess 32. At the same time, the bracket 20 arrives in the area of the slot 28. When now the swivel movement is completed counterclockwise, the plug-type bracket 19 arrives in the area inside the U-shaped recess 33 and impacts there. In this position, the end 27*a* of the elastic detent hook 27 is released and is placed against the surface of the bracket 19 which is directed to the outside so that a return movement is prevented. The stop part 25 rests against the lateral part 6 and the bracket 20 has arrived in its end position inside the slot 28. The fan shroud 7 is mounted in a form-locking manner. It can be demounted again when the detent hook 27 is pressed toward the inside.

The whole mounting and also a demounting operation may take place without the aid of a tool. The swivel operation is extremely simple, and a separate alignment of the upper and lower edges becomes superfluous. Only the sleeve 14 must be guided in the suitable position by way of the swivel pin 16. Once this has happened, it will be sufficient for counterclockwise pressure to be applied to the fan shroud which will then swivel into its mounting position.

In the shown embodiment, so-called water boxes are shown as the collecting tanks because a liquid cooling medium flows through the ribbed tube block. However, in a similar manner, it would also be possible to construct the collecting tanks 3, 4 illustrated in the embodiment as air receivers for the operation of the heat exchanger as an air/air cooler, so that, for example, a charge air cooler can be formed which has the same constructional characteristics as the illustrated embodiment.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Heat exchanger, particularly a radiator for internal-combustion engines of commercial vehicles, comprising:

a fan shroud which is arranged in front of a ribbed tube block and which is held on collecting tanks of the ribbed tube block by means of a form closure of mutually engaging plug-type brackets with detent devices upon relative movement of the fan shroud and ribbed tube block, wherein at least one swivel pin hinge connection is provided between the fan shroud and the collecting tanks, and wherein the plug-type brackets and the detent devices are arranged such that the form closure takes placed by a swivelling of the fan shroud about the swivel pin.

2. Heat exchanger according to claim 1, wherein the swivel pin is arranged on a lower collecting tank and at least one plug-type bracket is arranged on an upper collecting tank.

3. Heat exchanger according to claim 1, wherein the swivel pin is arranged in an area of a lateral part on a lower collecting tank, a plug-type bracket being assigned approximately to a center of an upper collecting tank, and another plug-type bracket being arranged on a side of the lower collecting tank which faces away from the swivel pin.

4. Heat exchanger according to claim 1, wherein a plug-type bracket is constructed on an upper collecting tank as a U-shaped receiving pocket into which a bracket connected with the fan shroud engages in a fitting manner.

5. Heat exchanger according to claim 2, wherein the plug-type bracket is constructed on the upper collecting tank as the U-shaped receiving pocket into which the bracket connected with the fan shroud engages in a fitting manner.

6. Heat exchanger according to claim 3, wherein the plug-type bracket is constructed on the upper collecting tank as the U-shaped receiving pocket into which the bracket connected with the fan shroud engages in a fitting manner.

7. Heat exchanger according to claim 4, wherein the bracket is held on the fan shroud in an end position by means of an elastic detent hook which is fastened on the collecting tank.

8. Heat exchanger according to claim 6, wherein the bracket is held on the fan shroud in an end position by means of an elastic detent hook which is fastened on the collecting tank.

9. Heat exchanger according to claim 1, wherein a plug-type bracket on a lower collecting tank is a shackle with a plug-type slot into which an insertion bracket can be inserted which projects from the fan shroud.

10. Heat exchanger according to claim 2, wherein a plug-type bracket on a lower collecting tank is a shackle with a plug-type slot into which an insertion bracket can be inserted which projects from the fan shroud.

11. Heat exchanger according to claim 3, wherein a plug-type bracket on a lower collecting tank is a shackle with a plug-type slot into which an insertion bracket can be inserted which projects from the fan shroud.

12. Heat exchanger according to claim 4, wherein a plug-type bracket on a lower collecting tank is a shackle with a plug-type slot into which an insertion bracket can be inserted which projects from the fan shroud.

13. Heat exchanger according to claim 9, wherein the insertion bracket is arranged on the fan shroud in such a manner that its longitudinal axis extends approximately tangentially with respect to a circular arc whose center is the swivel pin.

14. Heat exchanger according to claim 10, wherein the insertion bracket is arranged on the fan shroud in such a manner that its longitudinal axis extends approximately tangentially with respect to a circular arc whose center is the swivel pin.

15. Heat exchanger according to claim 11, wherein the insertion bracket is arranged on tile fan shroud in such a manner that its longitudinal axis extends approximately tangentially with respect to a circular arc whose center is the swivel pin.

16. Heat exchanger according to claim 12, wherein the insertion bracket is arranged on the fan shroud in such a manner that its longitudinal axis extends approximately tangentially with respect to a circular arc whose center is the swivel pin.

17. Heat exchanger according to claim 4, wherein a contact web is assigned to the bracket arranged on top on the fan shroud, which contact web, in the end position, is pressed onto a contact surface of the collecting tank.

18. Heat exchanger according to claim 5, wherein a contact web is assigned to the bracket arranged on top on the fan shroud, which contact web, in the end position, is pressed onto a contact surface of the collecting tank.

19. Heat exchanger according to claim 6, wherein a contact web is assigned to the bracket arranged on top on the fan shroud, which contact web, in the end position, is pressed onto a contact surface of the collecting tank.

* * * * *